US008444263B2

(12) United States Patent
Kojima

(10) Patent No.: US 8,444,263 B2
(45) Date of Patent: May 21, 2013

(54) LIQUID DROPLET DISCHARGING APPARATUS

(75) Inventor: Kenji Kojima, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 176 days.

(21) Appl. No.: 13/035,348

(22) Filed: Feb. 25, 2011

(65) Prior Publication Data

US 2011/0216141 A1 Sep. 8, 2011

(30) Foreign Application Priority Data

Mar. 3, 2010 (JP) ..... 2010-046233

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

2006/0050106 A1* 3/2006 Kojima ..... 347/37

FOREIGN PATENT DOCUMENTS

JP 2006-043496 A 2/2006

* cited by examiner

*Primary Examiner* — Stephen Meier
*Assistant Examiner* — Tracey McMillion
(74) *Attorney, Agent, or Firm* — Global IP Counselors, LLP

(57) ABSTRACT

The liquid droplet discharging apparatus has an image formation area, a workpiece exchange area, a set table that has a slider and is configured to support a workpiece thereon, and a guide section configured to guide a movement of the set table between the image formation area and the workpiece exchange area by guiding the slider. The guide section is divided into two sections corresponding to the image formation area and the workpiece exchange area.

6 Claims, 7 Drawing Sheets

LIQUID DROPLET DISCHARGING APPARATUS

CROSS-REFERENCE TO RELATED APPLICATIONS

This application claims priority to Japanese Patent Application No. 2010-046233 filed on Mar. 3, 2010. The entire disclosure of Japanese Patent Application No. 2010-046233 is hereby incorporated herein by reference.

BACKGROUND

1. Technical Field

The present invention relates to a liquid droplet discharging apparatus configured to form an image on a workpiece while moving the workpiece and a functional liquid droplet discharging head relative to each other.

2. Related Art

A known example of this kind of liquid droplet discharging apparatus has an image formation area in which an image is formed on a workpiece while the workpiece and a functional liquid droplet discharging head are moved relative to each other and a workpiece exchange area separated from the image formation area where workpieces are exchanged (see Japanese Laid-Open Patent Publication No. 2006-43496).

The liquid droplet discharging apparatus includes a set stage configured for a workpiece to be set thereon, an X-axis movement table configured to move a workpiece along an X-axis direction between the image formation area and the workpiece exchange area by moving the set stage, a carriage having a plurality of functional liquid droplet discharging heads configured to discharge a functional liquid, and a Y-axis movement table configured to move the carriage along a Y-axis direction.

The X-axis movement table has a slider configured to support the set stage, a guide section configured to guide a movement of the slider between the image formation area and the workpiece exchanging area, and a base section configured to support the guide section. The base section comprises a concrete structural body and the guide section comprises a single granite surface plate. By making the fundamental parts of the apparatus out of materials that do not readily warp or otherwise become disfigured, the set stage can be moved with a high degree of precision to ensure good image quality.

SUMMARY

In the conventional liquid droplet discharging explained above, a movement range of the X-axis movement table (and, thus, of the set stage) is excessively long because the workpiece exchange area is located outside the image formation area. Consequently, the guide section and the base section serving as a foundation of the apparatus are also long. In the particular case of a larger liquid droplet discharging apparatus configured to form an image on a larger-sized workpiece, the apparatus must be constructed such that the guide section and the base section are sufficiently strong in addition to being long. Consequently, the cost of the guide section and the base section are higher and the individual weights of these parts are extremely large, making them more difficult to transport. When the guide diagram (and the base section) is larger, it is more difficult to ensure mechanical precision and the image formation precision declines.

The present invention was conceived based on the observation that a high degree of mechanical precision is required in the image formation area while not such a high degree of mechanical precision is required in the workpiece exchange area. The object of the present invention is to provide a liquid droplet discharging apparatus that maintains a high degree of image formation precision while reducing cost and unit weight.

A liquid droplet discharging apparatus according to a first aspect includes an image formation area, a workpiece exchange area, a set table and a guide section. The image formation area is an area in which an image is formed on a workpiece by driving an injection-type functional liquid droplet discharging head in synchronization with moving the workpiece. The workpiece exchange area is an area in which supplying and removing of the workpiece is executed. The workpiece exchange area is separated from the image formation area along a movement direction of the workpiece. The set table has a slider, and configured to support the workpiece thereon. The guide section is configured to guide a movement of the set table between the image formation area and the workpiece exchange area by guiding the slider, the guide section being divided into two sections corresponding to the image formation area and the workpiece exchange area.

A liquid droplet discharging apparatus according to another aspect includes an image formation area, a pair of workpiece exchange areas, a pair of set tables and a guide section. The image formation area is an area in which an image is formed on a workpiece by driving an injection-type functional liquid droplet discharging head in synchronization with moving the workpiece. The workpiece exchange areas are areas in which supplying and removing of the workpiece is executed. The workpiece exchange areas are located on opposite sides of the image formation area in positions separated from the image formation area along a movement direction of the workpiece. The set tables each has a slider and is configured to support the workpiece thereon. The guide section is configured to guide movements of the set tables between the image formation area and the workpiece exchange areas by guiding the sliders. The guide section is divided into three sections corresponding to the image formation area and the workpiece exchange areas.

With these constituent features, a standalone length of the guide section is shorter because the guide section is divided into two sections (or three sections) corresponding to the image formation area and the workpiece exchange area(s). As a result, the cost of the guide section can be reduced and a standalone weight of the guide section can be reduced. Also, a high degree of mechanical precision can be attained and an image formation precision can be maintained because guide section is not divided within the image formation area.

The apparatus preferably further includes a base body configured to support the guide section across a region spanning through the image formation area and the workpieces exchange area, the base body being divided into two sections corresponding to the image formation area and the workpiece exchange area.

Similarly, the apparatus preferably further includes a base body supporting the guide section across an entire region spanning through the image formation area and the two workpieces exchange areas, the base body being divided into three sections corresponding to the image formation area and the two workpiece exchange areas.

With these constituent features, both the standalone weight and the cost of the base body can be reduced because the base body is divided in two (or three). Moreover, the image formation precision can be maintained because the base body is not divided in the image formation area.

The guide section is preferably a granite surface plate having a rectangular cross section and the slider is preferably an air slider guided by an upper surface and both side surfaces of the guide section.

With these constituent features, since the slider is guided in a stable manner by the top surface and two side surfaces of the guide section, the set table can be moved appropriately between the image formation area and the workpiece exchange area even if the guide section (and the base body) is divided. The sections of the divided guide member (and base body) are preferably positioned and connected with connecting means at mating portions thereof.

BRIEF DESCRIPTION OF THE DRAWINGS

Referring now to the attached drawings which form a part of this original disclosure.

DETAILED DESCRIPTION OF EXEMPLARY EMBODIMENTS

A liquid droplet discharging apparatus according to an embodiment of the present invention will now be explained with reference to the appended drawings. This liquid droplet discharging apparatus is intended to be installed in a manufacturing line for flat panel displays and uses an injection-type functional liquid droplet discharging head supplied with a functional liquid—e.g., a special ink or a liquid resin having a light emitting property—to form (image formation) a color filter or light emitting elements serving as pixels of an organic EL device. The liquid droplet discharging apparatus is also configured to maintain and recover (maintenance) the functionality of the functional liquid droplet discharging head. In the explanation that follows, a movement direction of a workpiece is called an X-axis direction (main scanning direction) and a movement direction of the functional liquid droplet discharging head (carriage unit) is called a Y-axis direction (subordinate scanning direction).

Figure 1:
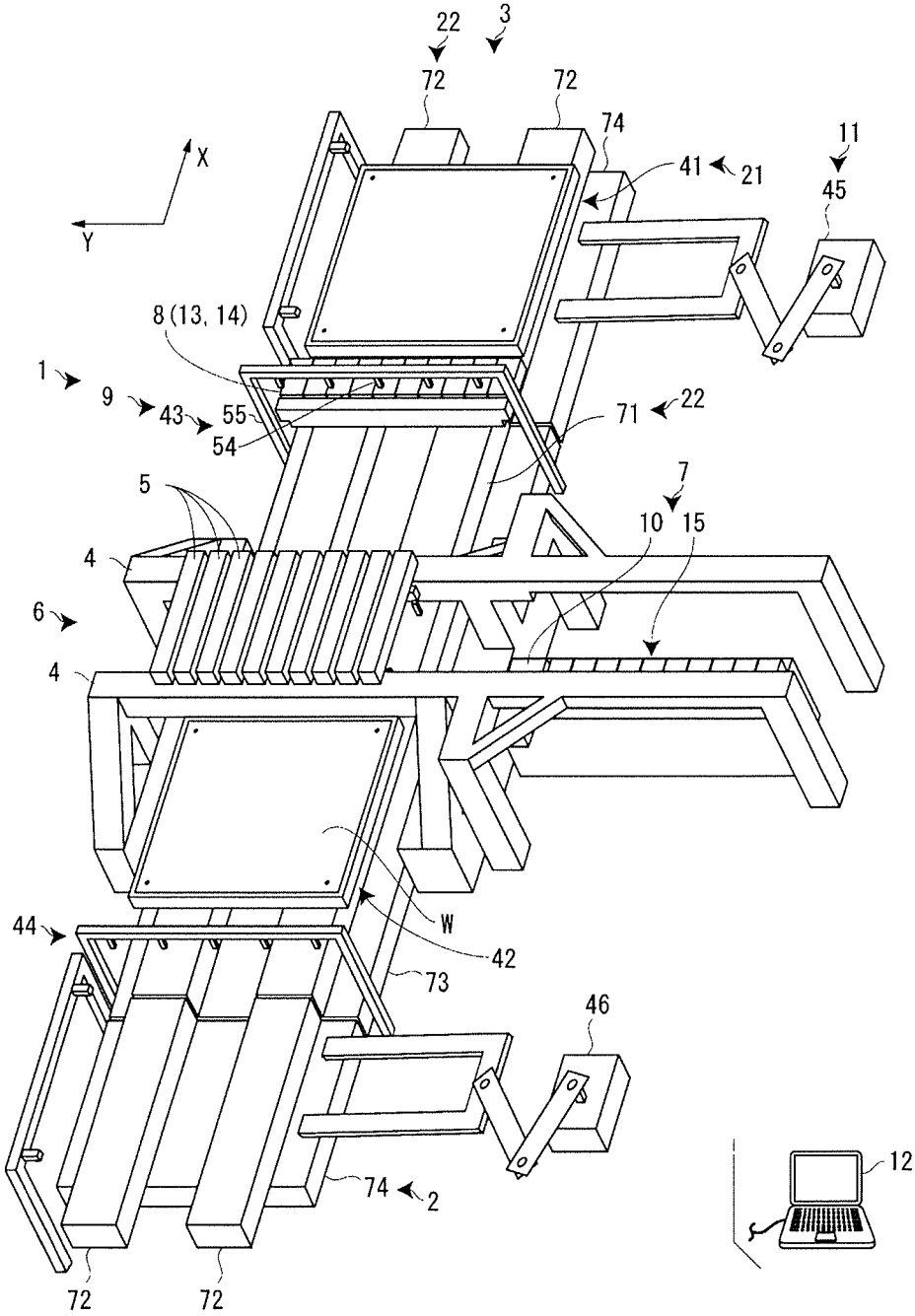
FIG. 1 is a perspective view of the liquid droplet discharging apparatus.
Figure 2:
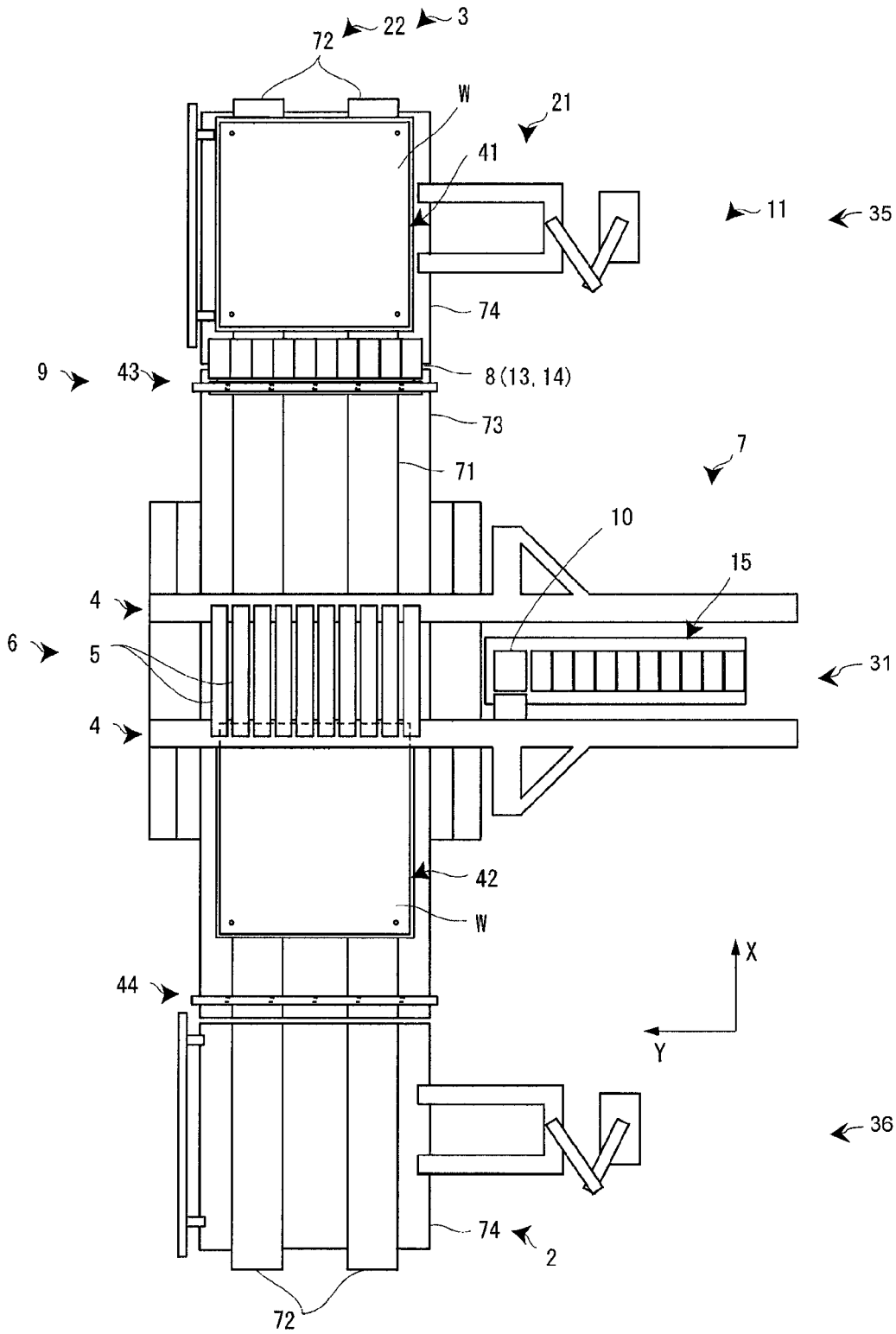
FIG. 2 is a plan view of the liquid droplet discharging apparatus.
Figure 3:
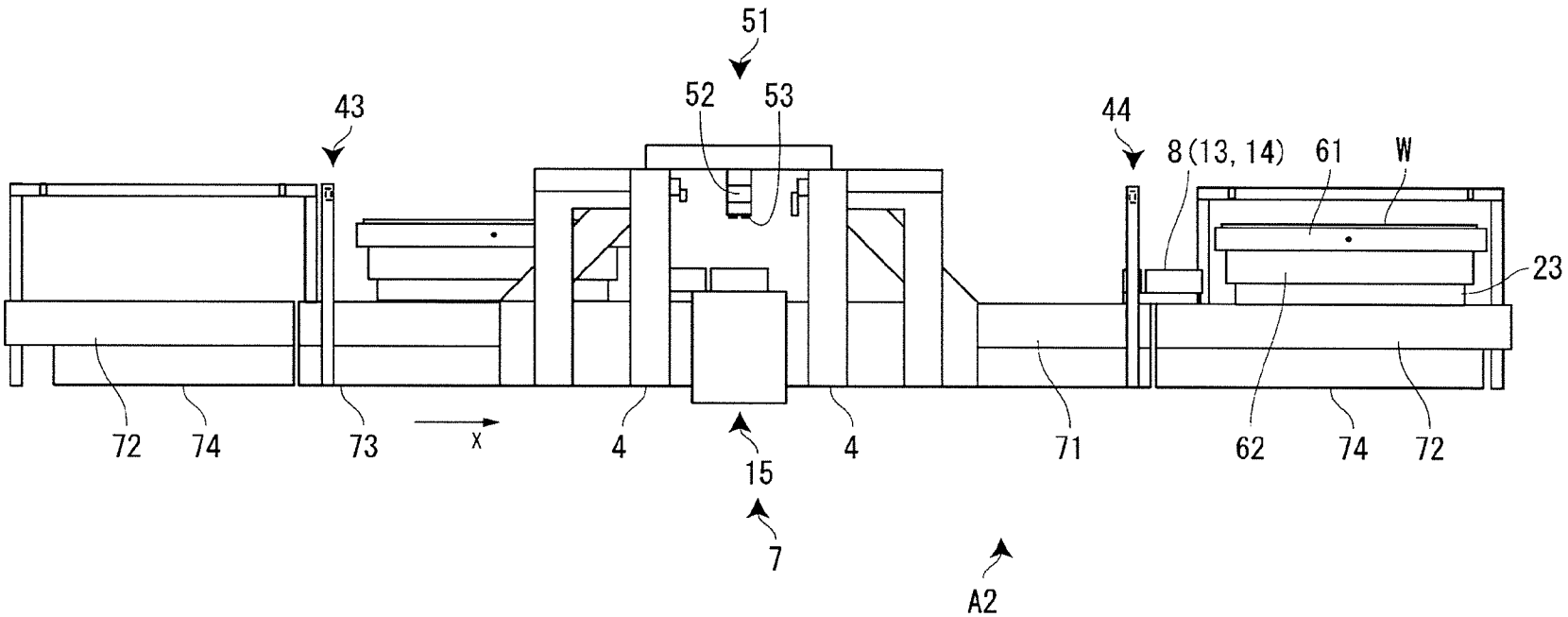
FIG. 3 is a side view of the liquid droplet discharging apparatus.

As shown in FIGS. 1 to 3, the liquid droplet discharging apparatus 1 comprises a machine platform base (base body) 2, an X-axis table 3 arranged to extend in an X-axis direction and configured to move a set workpiece W along an X-axis direction, a pair of Y-axis support bases 4 arranged to straddle across the X-axis table 3, a plurality of (e.g., ten) carriage units 5 having a plurality of functional liquid droplet discharging heads 53 mounted thereon, a Y-axis table 6 arranged on the pair of Y-axis support bases 4 and configured to move the carriage units 5 (i.e., the functional liquid droplet discharging heads 53) along a Y-axis direction, a maintenance apparatus 7 that faces the Y-axis table 6 from underneath at a position separated from the X-axis table 3 and configured to be used for maintenance of the functional liquid droplet discharging heads 53, an inspection stage 8 mounted on the X-axis table 3, and a pair of image recognizing units 9 configured to move in coordination with the inspection stage 8 and conduct discharge inspections of the functional liquid droplet discharging heads 53.

The liquid droplet discharging apparatus 1 further comprises a pair of workpiece exchanging robots 11 configured to exchange workpieces W with respect to the X-axis table 3, a chamber (omitted from drawings) configured to enclose the components described above in an atmosphere in which temperature and humidity are controlled, and a control device 12 configured to execute general control of the entire apparatus. Also, a flushing stage 13 configured to catch waste discharge (flushed liquid) from the functional liquid droplet discharging heads 53 and a weight measuring stage 14 configured to measuring a weight of functional liquid discharged from the functional liquid discharging heads 53 are mounted on the X-axis table 3.

The maintenance apparatus 7 has a suction unit 15 configured to perform capping and suction with respect to the functional liquid droplet discharging heads 53, a wiping unit 16 configured to wipe a nozzle face of the functional liquid droplet discharging heads 53 after suction. When the liquid droplet discharging apparatus 1 is started and when maintenance is required, the Y-axis table 6 is operated to move the functional liquid droplet discharging heads 53 to the suction unit 15 and the wiping unit 16 and maintenance is performed as required.

The X-axis table 3 has a pair of workpiece stages 21 each configured for a workpiece W to be set thereon, a pair of X-axis movement guides (guide section) 22 configured to guide movements of the workpiece stages 21 along the X-axis direction, a pair of X-axis sliders (sliders) 23 configured to support the workpiece stages 21 such that they can slide freely on the pair of X-axis guides 22, an inspection slider 24 configured to support the inspection state 8 such that it can slide freely on the pair of X-axis guides 22, and an X-axis linear motor 25 configured to move the pair of workpiece stages 21 by moving the X-axis sliders 23 and to move the inspection stage 8 by moving the inspection slider 24.

Similarly, the Y-axis table 6 has a plurality of bridge plates (not shown in the drawings) configured to support the carriage units 5, a pair of Y-axis movement guides 26 configured to move the bride plates along a Y-axis direction, a plurality of Y-axis sliders configured to support the bridge plates such that they can slide freely on the pair of Y-axis movement guides 26, and a Y-axis linear motor (not shown in the drawings) configured to move the carriage units 5 by moving the Y-axis sliders.

An image formation area 31 where workpieces W undergo an image forming operation is established in an intersecting region of the X axis table 3 and the Y axis table 6, and a maintenance area 32 in which the maintenance apparatus 7 is arranged is provided in a region where the Y axis table 6 moves along Y axis direction away from the image formation area 31. A first inspection area 33 and a second inspection area 34 are established on opposite sides of the image formation area 31 in positions separated outwardly along the X axis direction and serve as areas for inspecting results of inspection discharges discharged from the functional liquid droplet discharging heads 53. Additionally, a first workpiece exchange area 35 and a second workpiece exchange area 36 are established on opposite sides of the inspection areas 33 and 34 in positions separated farther outwardly along the X axis direction and serve as areas where workpieces W are supplied to and removed from the apparatus. Thus, in the liquid droplet discharging apparatus 1 according to this embodiment, the image formation area 31 is provided in a center position along the X axis direction and the pair of inspection areas 33 and 34 and the pair of workpiece exchange areas 35 and 36 are provided in positions located outwardly from both sides of the image formation area 31 along the X axis.

The pair of workpiece stages 21 comprises a first workpiece stage 41 and a second workpiece stage 42. The first workpiece stage 41 moves between the first workpiece exchange area 35 and image formation area 31, and the second workpiece exchange stage 42 moves between the second workpiece exchange area 36 and the image formation area 31. The pair of image recognizing units 9 comprises a first image recognizing unit 43 and a second image recognizing unit 44. The first image recognizing unit 43 is arranged in the first inspection area 33, and the second image recognizing unit 44 is arranged in the second inspection area 34. The inspection stage 8 moves between the first inspection area 33 and the second inspection area 34 and receives an inspection discharge from the functional liquid discharging heads 53 (carriage units 5) while passing through the image formation area 31. The pair of workpiece exchanging units 11 comprises a first workpiece exchanging unit 45 and a second workpiece exchanging unit 46. The first image recognizing unit 45 is arranged in the first workpiece exchange area 35, and the second image recognizing unit 46 is arranged in the second workpiece exchange area 36.

As shown in FIG. 3, each of the carriage units 5 comprises a head unit 51 equipped with twelve functional liquid droplet discharging heads 53 and a head rotating mechanism 52 configured to support the head unit 51 on the Y-axis table 6 such that the head unit 40 can θ-rotate and move up and down freely. The head unit 51 is configured to have six functional liquid discharging heads 53 attached to a left side of a carriage plate (not shown in the drawings) and six functional liquid discharging heads 53 attached to a right side of the carriage plate. Left-right pairs of (two) functional liquid droplet discharging heads 53 discharge the same type of functional liquid, and the six pairs of functional liquid droplet discharging heads 53 are arranged in a stair-like fashion from a higher position to a lower position. Each of the functional liquid droplet discharging heads 53 comprises an inkjet head that is driven with a piezoelectric element and has two rows of nozzles in a nozzle face. The number of carriage units 5 and the number of functional liquid droplet discharging heads 53 provided on each of the carriage units 5 are arbitrary.

The inspection stage 8 comprises a suction stage configured to use suction to hold an inspection sheet dispensed from a roll, a dispensing mechanism configured to dispense the inspection sheet to the suction stage, and a winding mechanism configured to wind in used portion of the inspection sheet after an inspection (none of these parts of the inspection stage 8 are shown in the drawings). The inspection stage 8 is configured to receive an inspection discharge from the functional liquid droplet discharging heads 53 while holding a portion of the inspection sheet dispensed from the dispensing mechanism with suction on the suction stage.

Each of the image recognizing units 9 includes a plurality of (e.g., five) cameras 54 arranged facing the inspection stage 8 from above, a plurality of camera platforms (not shown in drawings) configured to support the cameras 54, a camera frame 55 arranged to span across the machine platform base 2 and configured to support the camera platforms such that they can slide freely along the Y-axis direction, and a camera moving mechanism (not shown in the drawings) configured to move the cameras 54 along the camera frame 55 in the Y-axis direction by moving the camera platforms. The image recognizing unit 9 is configured to execute image recognition with respect to liquid droplets discharged onto the inspection sheet in a continuous fashion several droplets at a time while moving the inspection cameras 54 along the Y-axis direction by moving the camera platforms. The inspection results obtained with the image recognition are sent to the control device 12 and the control device 12 executes an inspection (discharge inspection) by inspecting for missing dots and curved droplet flight paths.

A sequence of operations executed by the liquid droplet discharging apparatus 1 will now be explained with reference to FIG. 4.

Figure 4:
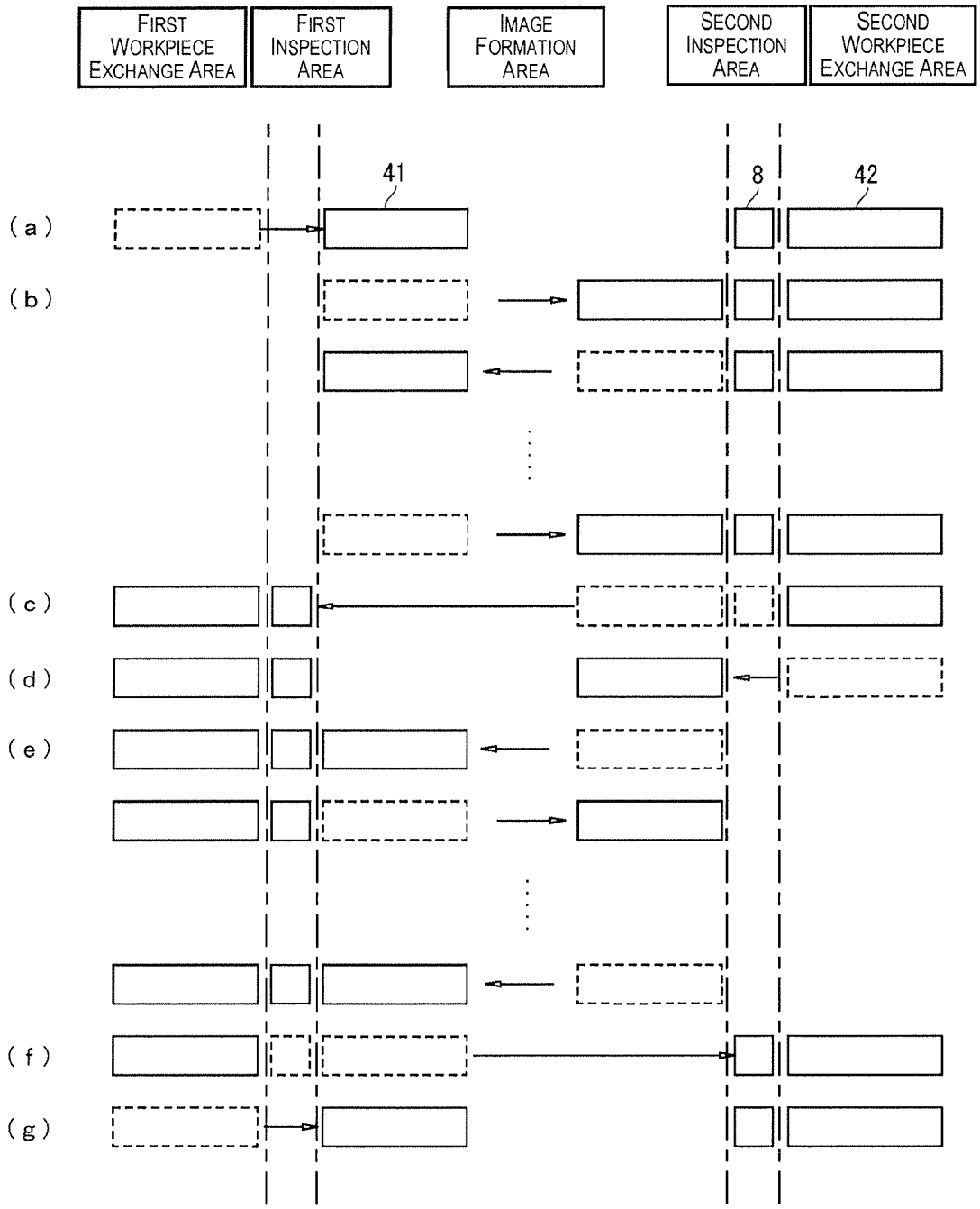
FIG. 4 includes a series of schematic diagrams showing operations executed by the liquid droplet discharging apparatus.

FIG. 4 expresses in a simplified manner positional relationships among the first workpiece stage 41, the second workpiece stage 42, and the inspection stage 8 during a sequence of operations executed by the liquid droplet discharging apparatus 1. After a workpiece W is supplied to and aligned on the first workpiece stage 41 by the first workpiece exchanging robot 45 while the first workpiece stage 41 is positioned in the first workpiece exchange area 35, the first workpiece stage 41 moves to a image formation start position of the image formation area 31. When image formation starts, the first workpiece stage 41 moves back and forth a number of times (N times) within the image formation area 31 while the functional liquid droplet discharging heads 53 (carriage units 5) discharge functional liquid onto the workpiece W to form an image (diagram (b) of FIG. 4). During this period, the inspection stage 8 waits in the second inspection area 34 and the second workpiece stage 42 receives a fresh workpiece W and has that workpiece W aligned by the second workpiece exchanging unit in the second workpiece exchange area 36.

After the first workpiece stage 41 finishes a final movement operation (Nth movement operation), it performs a final return operation (Nth return operation) and leaves the image formation area 31. It then passes through the first inspection area 33 and arrives at the first workpiece exchange area 35. In synchronization with the first workpiece stage 41 finishing the final return operation and moving to the first workpiece exchange area 35, the inspection stage 8 follows the first workpiece stage 41 and passes from the second inspection area 34 through the image formation area 31 to the first inspection area 33 (diagram (c) of FIG. 4). The inspection stage 8 receives an inspection discharge from the functional liquid droplet discharging heads 53 when (while) it passes through the image formation area 31.

In synchronization with the movements of the first workpiece stage 41 and the inspection stage 8, the second workpiece stage 42 moves to the image formation start position of the image formation area 31 carrying a fresh workpiece W (diagram (d) of FIG. 4). The events of diagram (c) and diagram (d) of FIG. 4 actually occur simultaneously. When image formation starts, the second workpiece stage 42 moves back and forth a number of times (N times) within the image formation area 31 while the functional liquid droplet discharging heads 53 (carriage units 5) discharge functional liquid onto the workpiece W (diagram (e) of FIG. 4). Meanwhile, the first workpiece stage 41 has moved to the first workpiece exchange area 35 and a workpiece W is supplied to and aligned on the first workpiece stage 41 by the first workpiece exchanging robot 45. Additionally, the inspection stage 8 has moved to the first inspection area 31, where the result of the inspection discharge is inspected by the first image recognizing unit 43. Thus, the workpiece exchange operation executed at the first workpiece exchange area 35, the discharge inspection executed at the first inspection area 33, and the image forming operation executed at the image formation area 31 are executed in parallel with one another.

After the second workpiece stage 42 finishes a final movement operation (Nth movement operation), it performs a final return operation (Nth return operation) and leaves the image formation area 31. It then passes through the second inspection area 34 and arrives at the second workpiece exchange area 36. In synchronization with the second workpiece stage 42 finishing the final return operation and moving to the second workpiece exchange area 36, the inspection stage 8 follows the second workpiece stage 42 and passes from the first inspection area 33 through the image formation area 31 to the second inspection area 34 (diagram (f) of FIG. 4). That is, the discharge inspection of the inspection stage 8 executed at the first inspection area 33 is completed by the time the final move operation (Nth move operation) of the second workpiece stage 42 is finished.

Figure 5:
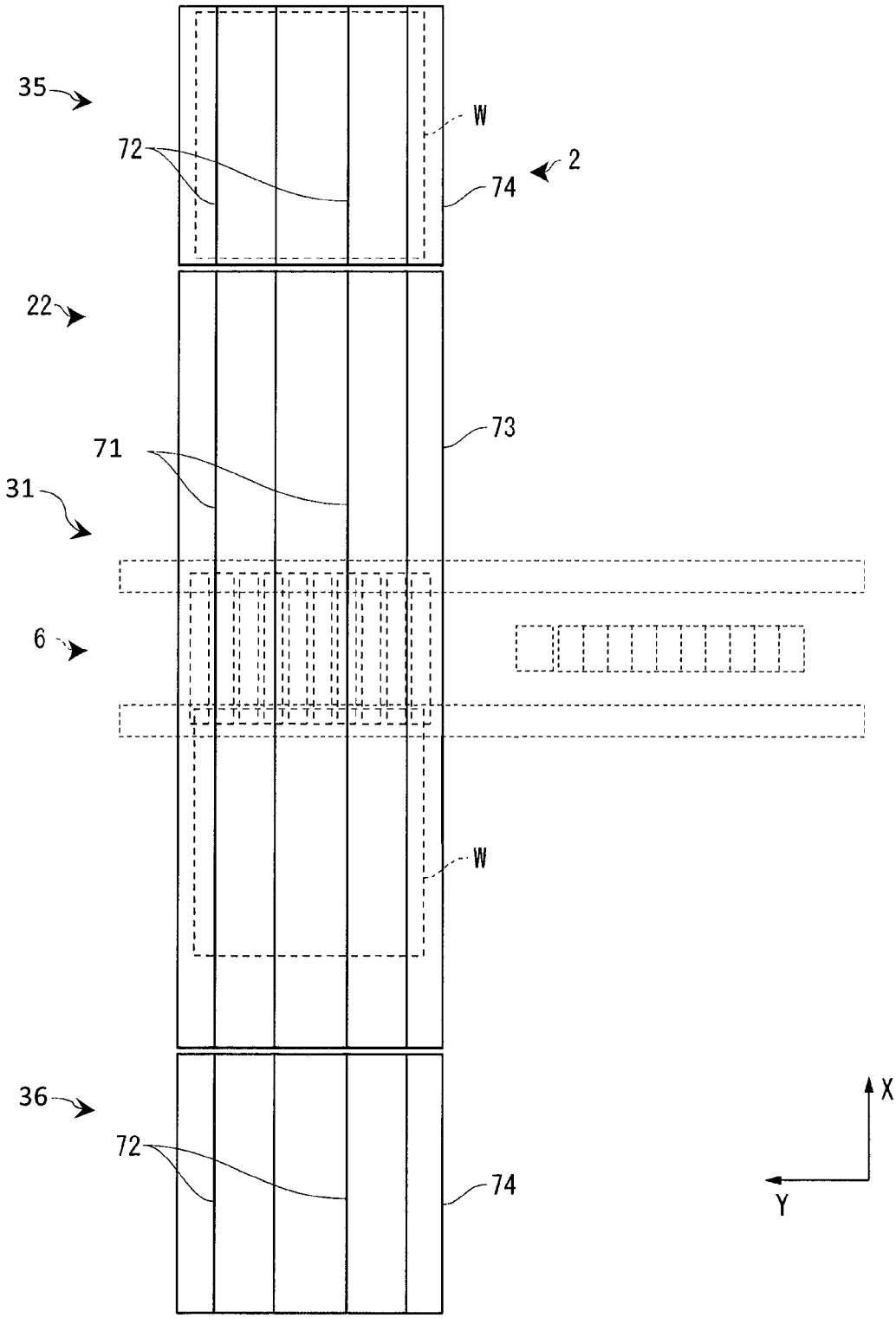
FIG. 5 is a plan view of an X-axis table according to a first embodiment.
Figure 6:
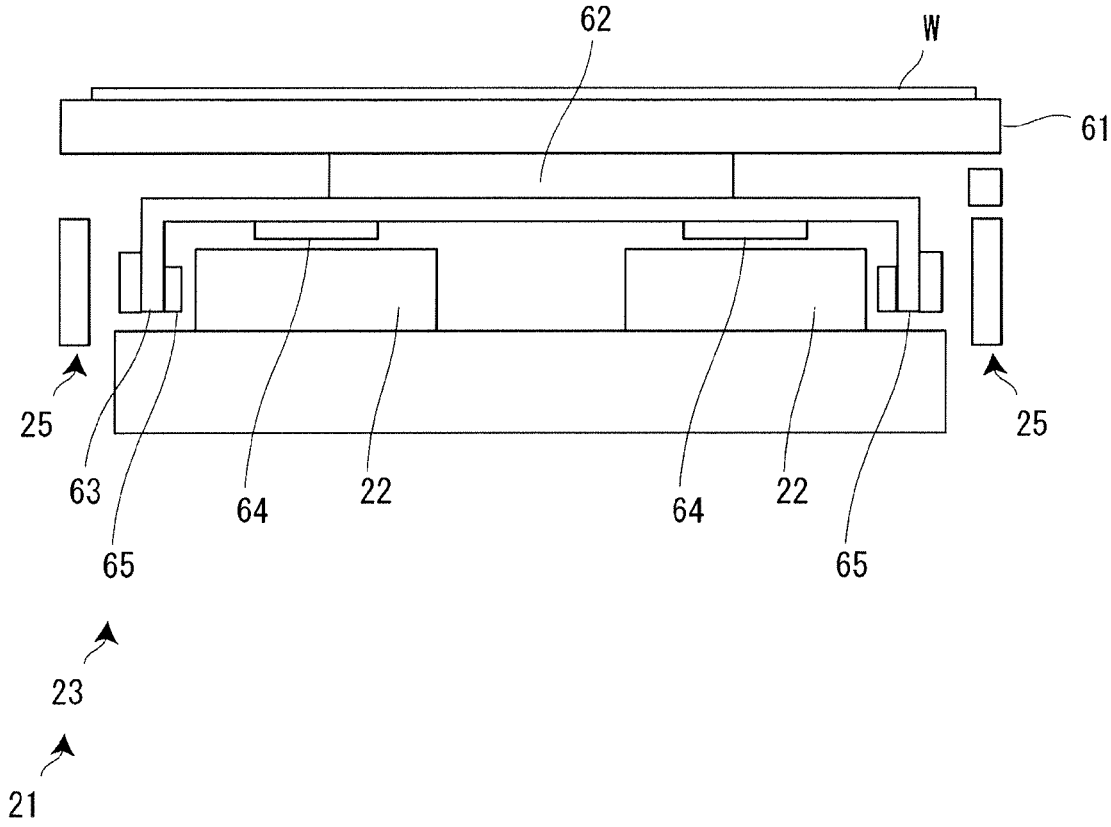
FIG. 6 is a cross sectional view of a workpiece table and surrounding parts.

Structural features surrounding the X-axis table 3 will now be explained with reference to FIG. 1, FIG. 5, and FIG. 6. As explained previously, the X-axis table 3 is fixed on the machine platform base 2 and includes the pair of workpiece stages 21, the pair of X-axis movement guides 22, the pair of X-axis sliders 23, the inspection slider 24, and the X-axis linear motor 25. The first workpiece stage 41 and the second workpiece stage 41 are mounted on the pair of X-axis sliders 23 and the inspection stage 8 is mounted on the inspection slider 24.

Each of the workpiece stages 21 has a suction table 61 configured to hold an aligned workpiece W with suction and a 0 table 62 configured to support and θ-rotate the suction table 61. The X-axis sliders 23 are provided on a bottom surface of the workpiece stages 21 and the inspection slider 24 is provided on a bottom surface of the inspection stage 8. Since the pair of X-axis sliders 23 and the inspection slider 24 are air sliders having basically the same structure, only one of the X-axis sliders 23 will now be explained as a representative example.

The X-axis slider 23 comprises a slider body 63 configured to directly support the workpiece stage 21 (θ-table 62) and a pair of floating-purpose air pads 64 and a pair of width restricting air pads 65 attached to the slider body 63. One of the floating-purpose air pads 64 is arranged facing opposite an upper surface of one of the X-axis movement guides 22, and one of the width restricting air pads 65 is arranged facing an outside side face of the same X-axis movement guide 22. Similarly, the other of the floating-purpose air pads 64 is arranged facing opposite an upper surface of the other of the X-axis movement guides 22, and the other of the width restricting air pads 65 is arranged facing an outside side face of the other X-axis movement guide 22. A stator of the X-axis linear motor 25 is fixed to the X-axis movement guide 22, a slider is fixed to the slider body 63, and the stator of the X-axis linear motor 25 extends in the X-axis direction so as to span across the two workpiece exchange areas 35 and 36. It is also acceptable to provide a left-right pair of X-axis linear motors 25.

The two X-axis movement guides 22 are arranged parallel to each other on the machine platform base 2 and extend along the X-axis direction so as to span across the two workpiece exchange areas 35 and 36. Each of the X-axis movement guides 22 comprises a base such as a granite surface plate having a rectangular cross sectional shape and is divided into three sections: an image formation movement guide 71 corresponding to the image formation area 31 and a pair of workpiece exchange movement guides 72 corresponding to the two workpiece exchange areas 35 and 36. Both small ends of the image formation movement guide 71 are abutted against one small end of each of the workpiece exchange movement guides 72 such that each of the X-axis movement guides 22 has a linear form (actually, a slight gap is provided between the abutted small ends). The image formation movement guide 71 and the two workpiece exchange movement guides 72 are supported and fixed on the machine platform base 2 such that the gaps between the small ends are on the order of several micrometers to several tens of micrometers. It is acceptable for a fastening device to be provided on the abutting portions of the small ends and for the gaps between the abutting small ends to be filled with an adhesive (caulking material). Instead of being configured to abut straight against one another at right angles in a plan view, it is also acceptable for the abutting portions between the image formation movement guide 71 and the two workpiece exchange movement guides 72 to be diagonal or crank-shaped in a plan view such that they partially overlap one another.

The machine platform base 2 is a rectangular base having such a size that it contains the X-axis table 3 and is made by die casting or as a concrete structural body obtained by pouring PC concrete into a steal frame. Similarly to the X-axis movement guides 22, the machine platform base 2 is divided into three sections: an image formation machine platform base 73 corresponding to the image formation area 31 and a pair of workpiece exchange machine platform bases 74 corresponding to the two workpiece exchange areas 35 and 36. Thus, the image formation machine platform base 73 is formed to have the same length as the image formation movement guides 71 and the workpiece exchange machine platform bases 74 and 74 are formed to have approximately the same length as the workpiece exchange movement guides 72. Both small ends of the image formation machine platform base 73 are abutted against one small end of each of the workpiece exchange machine platform bases 74 and 74 such that the machine platform base 72 has a linear form (actually, a slight gap is provided between the abutted small ends). Preferably, a fastening device is provided on the abutting portions of the small ends, and the gaps between the abutting small ends are filled with an adhesive (caulking material). Instead of being configured to abut straight against one another at right angles in a plan view, it is also acceptable for the abutting portions between the image formation machine platform base 73 and the two workpiece exchange machine platform bases 74 and 74 to be diagonal or crank-shaped in a plan view such that they partially overlap one another.

Since the X-axis movement guides 22 are divided into a plurality of sections, even if the workpieces W are aligned at the workpiece exchange areas 35 and 36, there is a possibility that the workpieces W will be misaligned with respect to the functional liquid droplet discharging head 53 when the workpieces W have been moved to the image formation area 31 for the image forming operation. Thus, in this embodiment, a potential deviation of a position of a workpiece W in the workpiece exchange area 35 or 36 with respect to a position of the workpiece W in the image formation area 31 is found experimentally in advance and the potential deviation is reflected in the image formation data.

Figure 7:
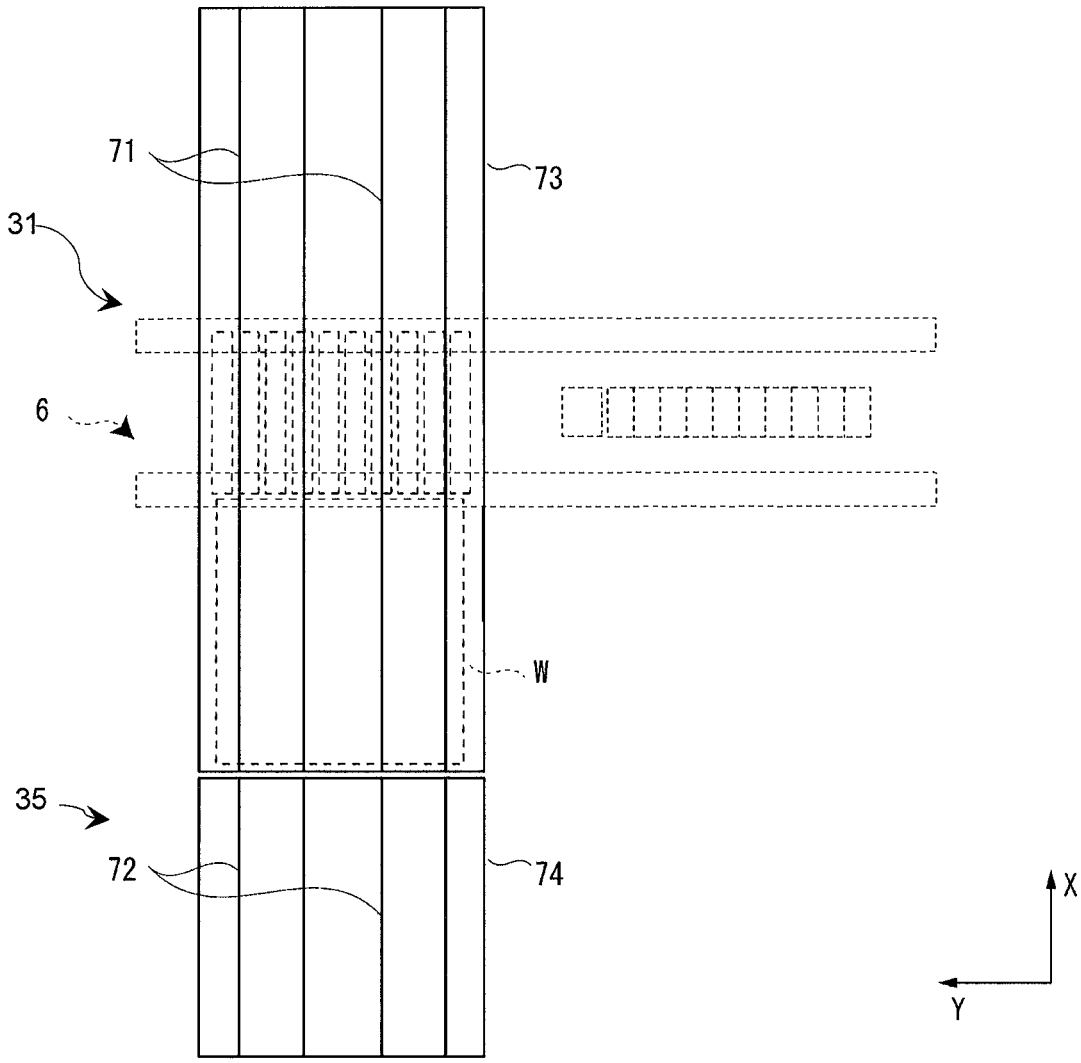
FIG. 7 is a plan view of an X-axis table according to a second embodiment.

A second embodiment of the present invention will now be explained with reference to FIG. 7. For the sake of brevity, only parts that are different from the first embodiment will be explained. The X-axis table 3 of the liquid droplet discharging apparatus 1 has a second workpiece stage 21 configured for a workpiece W to be set thereon, a pair of X-axis movement guides (guide section) 22, a pair of X-axis sliders (sliders) 23, and an inspection slider 24, and an X-axis linear motor 25. Also, in this liquid droplet discharging apparatus 1, a workpiece exchange area 35 where workpieces W are exchanged is located outward from one side of the image forming area 31 along an X-axis direction and a single inspection area 33 where results of inspection discharges discharged from functional liquid droplet discharging heads 53 are inspected is located outward from another side of the image forming area 31 along an X-axis direction.

An image recognizing unit 9 is arranged in the inspection area 33. After receiving an inspection discharge from the functional liquid droplet heads 53 (carriage units 5), an inspection stage 8 moves to the inspection area 33 where the results of the inspection discharge are inspected by image recognition. A workpiece exchanging robot 11 is arranged in the workpiece exchange area 35 in a position offset along a Y-axis direction and configured to exchange workpieces W with respect to the workpiece stage 21 when the workpiece stage 21 is in the workpiece exchange area 35.

The two X-axis movement guides 22 are arranged parallel to each other on the machine platform base 2 and extend along the X-axis direction so as to span across the single workpiece exchange area 35. Each of the X-axis movement guides 22 comprises a granite surface plate having a rectangular cross sectional shape and is divided into two sections: an image formation movement guide 71 corresponding to the image formation area 31 and a workpiece exchange movement guide 72 corresponding to the workpiece exchange area 35. One small end of the image formation movement guide 71 is abutted against one small end of the workpiece exchange movement guide 72 such that each of the X-axis movement guides 22 has a linear form (actually, a slight gap is provided between the abutted small ends). The image formation movement guide 71 and the workpiece exchange movement guide 72 are supported and fixed on the machine platform base 2 such that the gap between the small ends is on the order of several micrometers to several tens of micrometers. It is also acceptable for a fastening device to be provided on the abutting portions of the small ends and for the gap between the abutting small ends to be filled with an adhesive (caulking material).

Similarly to the X-axis movement guides 22, the machine platform base 2 is divided into two sections: an image formation machine platform base 73 corresponding to the image formation area 31 and a single workpiece exchange machine platform base 74 corresponding to the single workpiece exchange area 35. Thus, the image formation machine platform base 73 is formed to have the same length as the image formation movement guides 71 and the workpiece exchange machine platform base 74 is formed to have approximately the same length as the workpiece exchange movement guides 72. One small end of the image formation machine platform base 73 is abutted against one small end of the workpiece exchange machine platform base 74 such that the machine platform base 2 has a linear form (actually, a slight gap is provided in-between the abutted small ends). Preferably, a fastening device is provided on the abutting portions of the small ends, and the gaps between the abutting small ends are filled with an adhesive (caulking material).

It is also acceptable for the pair of X-axis movement guides 22 to be formed as a one piece integral unit that is divided into two sections or three sections (as in the first embodiment). It is acceptable, too, for the machine platform base 2 to be made as a single unit that is not divided.

In the embodiments described above, the standalone lengths of the X-axis movement guides 22 and the machine platform base 2 can be shortened because the X-axis movement guides 22 and the machine platform base 2 are divided into two sections (or three sections) between the image forming area 31 and the workpiece exchange areas. As a result, the cost of the X-axis movement guides 22 and the machine platform base 2 can be reduced and the standalone weights of the X-axis movement guides 22 and the machine platform base 2 can be reduced. Also, a high degree of mechanical precision can be achieved and an image formation precision can be maintained because the X-axis movement guides 22 and the machine platform base 2 are not divided within the image formation area.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid droplet discharging apparatus comprising:

an image formation area in which an image is formed on a workpiece by driving an injection-type functional liquid droplet discharging head;

a workpiece exchange area in which supplying and removing of the workpiece is executed, the workpiece exchange area being separated from the image formation area;

a set table having a slider, and configured to support the workpiece thereon;

a first guide section configured to guide a movement of the set table in the image formation area by guiding the slider; and a second guide section configured to guide the movement of the set table in the workpiece exchange area by guiding the slider, the second guide section being aligned with the first guide section, the first guide section and the second guide section being separate members from each other, the movement of the set table being further guided between the image formation area and the workpiece exchange area.

2. The liquid droplet discharging apparatus recited in claim 1, further comprising a base body supporting the first and second guide sections across a region spanning through the image formation area and the workpiece exchange area, the base body being divided into two sections corresponding to the image formation area and the workpiece exchange area.

3. A liquid droplet discharging apparatus comprising:

an image formation area in which an image is formed on a workpiece by driving an injection-type functional liquid droplet discharging head in synchronization with moving the workpiece;

a pair of workpiece exchange areas in which supplying and removing of the workpiece is executed, the workpiece exchange areas being arranged such that the image formation area lies between the workpiece exchange areas along a movement direction of the workpiece;

a pair of set tables each having a slider and configured to support the workpiece thereon; and a guide section configured to guide movements of the set tables between the image formation area and the two workpiece exchange areas by guiding the sliders, the guide section being divided into three sections corresponding to the image formation area and the workpiece exchange areas.

4. The liquid droplet discharging apparatus recited in claim 3, further comprising a base body supporting the guide section across a region spanning through the image formation area and the workpiece exchange areas, the base body being divided into three sections corresponding to the image formation area and the workpiece exchange areas.

5. The liquid droplet discharging apparatus recited in claim 1, wherein the first and second guide sections include a granite surface plate having a rectangular cross sectional shape, and the slider is an air slider guided by a top surface and two side surfaces of each of the first and second guide sections.

6. A liquid droplet discharging apparatus comprising:

an image formation area in which an image is formed on a workpiece by driving an injection-type functional liquid droplet discharging head in synchronization with moving the workpiece;

a pair of workpiece exchange areas in which supplying and removing of the workpiece is executed, the workpiece exchange areas being located on opposite sides of the image formation area in positions separated from the image formation area along a movement direction of the workpiece;

a pair of set tables each having a slider and configured to support the workpiece thereon; and a guide section configured to guide movements of the set tables between the image formation area and the workpiece exchange areas by guiding the sliders, the guide section being divided into three sections corresponding to the image formation area and the workpiece exchange areas.

* * * * *